US007147478B1

(12) United States Patent
Ju

(10) Patent No.: US 7,147,478 B1
(45) Date of Patent: Dec. 12, 2006

(54) ELECTRIC ELEMENT HAVING LIQUID METALS

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/230,583

(22) Filed: Sep. 21, 2005

(51) Int. Cl.
*H01R 12/00* (2006.01)

(52) U.S. Cl. ..... 439/66; 439/178; 439/179; 439/700; 439/824

(58) Field of Classification Search ..... 439/66, 439/178, 179, 591, 700, 824
See application file for complete search history.

(56) References Cited

U.S. PATENT DOCUMENTS 5,626,484 A * 5/1997 Okuyama et al. ..... 439/179
5,779,492 A * 7/1998 Okuyama et al. ..... 439/179
5,993,269 A * 11/1999 Ito ..... 439/824
6,113,406 A * 9/2000 Lin et al. ..... 439/179
6,379,844 B1 * 4/2002 Redey et al. ..... 429/231.9
6,740,829 B1 * 5/2004 Wong ..... 200/214
6,769,919 B1 * 8/2004 Kosmala ..... 439/66
6,776,668 B1 * 8/2004 Scyoc et al. ..... 439/700
6,908,347 B1 * 6/2005 Sasaki ..... 439/824
6,913,476 B1 * 7/2005 Yean et al. ..... 439/178
6,957,986 B1 * 10/2005 Jing ..... 439/700

* cited by examiner

*Primary Examiner*—Tho D. Ta
(74) *Attorney, Agent, or Firm*—Troxell Law Office, PLLC

(57) ABSTRACT

An electric element for electric connection of two corresponding electric elements comprises: two conductors; and liquid metals with low impedance connecting to the two conductors. The two conductors keep in contact with the liquid metals at a situation of relative movement so as to reduce significantly the impedance of the conductors and facilitate the signal transmissions.

13 Claims, 2 Drawing Sheets

ELECTRIC ELEMENT HAVING LIQUID METALS

BACKGROUND OF THE INVENTION (a) Field of the Invention

The present invention relates to electric elements, and particularly to an electric element with lower impedance.

(b) Description of the Prior Art

Presently an electric element (such as: electric connector) comprises generally an insulating body and at least one conductor received in the insulating body. The conductor is usually made of punching metal slices. However, the metal slices have higher impedance. Particularly when the conductor is in mechanic contact with a corresponding electric element, a contact portion usually has higher impedance. In addition, a conductor should be bent for ensuring the conductor with better elasticity in many situations, so that the impedance of the conductor is increased.

Therefore, it is necessary to develop a novel electric connector to overcome the above-mentioned defects.

SUMMARY OF THE INVENTION

Accordingly, the primary object of the present invention is to provide an electric element with lower impedance. In order to achieve the object of the present invention, the electric element for electric connection of two corresponding electric elements comprises: two conductors; and liquid metals with low impedance connecting to the two conductors. The two conductors keep in contact with the liquid metals at a situation of relative movement.

Comparing to prior arts, the liquid metals of the electric element of the present invention are used as a conductor for connecting two mental bodies so as to reduce significantly the impedance of the conductors and facilitate the signal transmissions.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
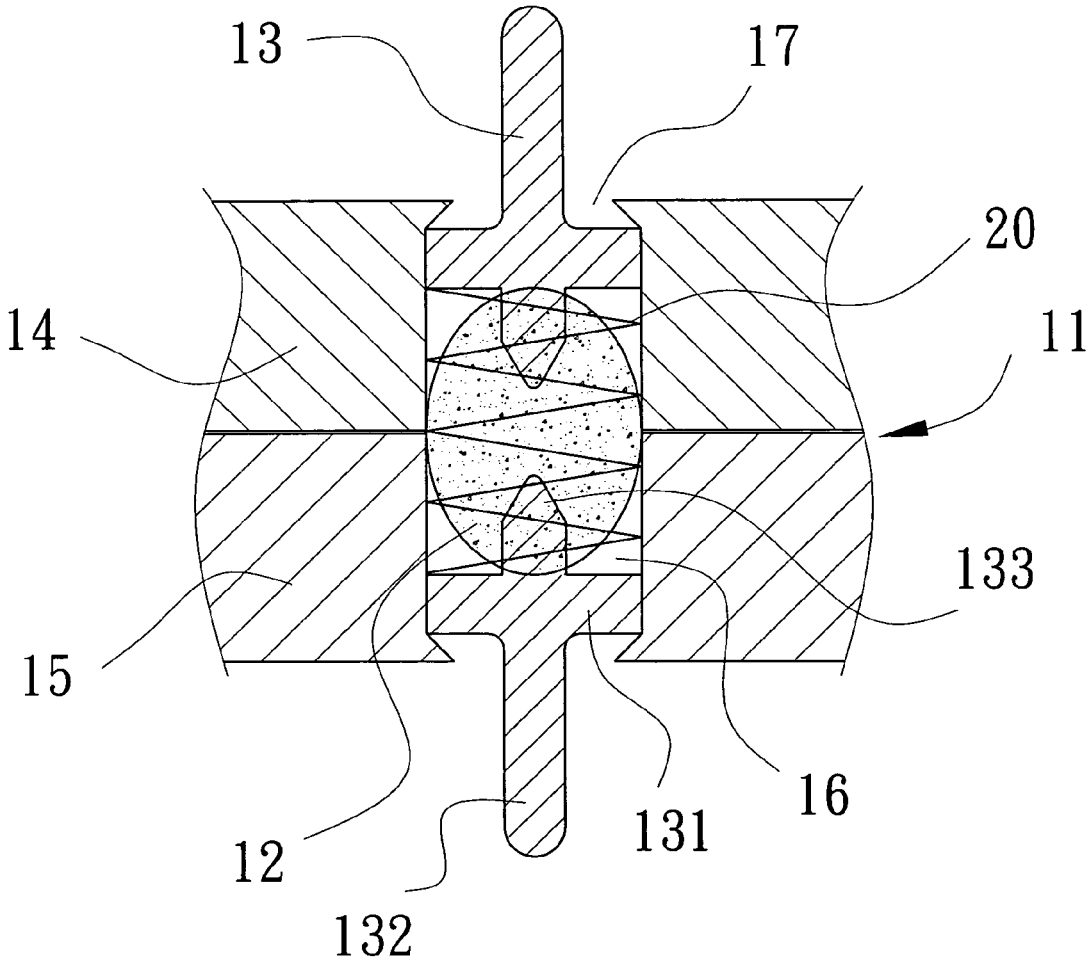
FIG. 1 is a perspective view of the electric element of the present invention.

Referring to FIG. 1, an electric element of the present invention is used for connecting one circuit board to another circuit board. The electric element has insulating bodies 11. The insulating body 11 comprises an upper layer 14 and a lower layer 15. The upper layer 14 and the lower layer 15 are fixed each other and form a receiving space 16. The receiving space 16 is filled with liquid metals 12 of low impedance (such as: mercury). The capacity of the receiving space 16 is slightly larger than the volume of the liquid metals 12 so that the liquid metals 12 as pressured thereof is capable of flowing into the intervals of the receiving space 16.

The two ends of the receiving space 16 have small openings 17. Two conductors 13 are installed respectively in the small openings 17. The conductors 13 are installed in protrusion 131 with larger sizes than the openings 17. One end of the protrusion 131 extends with a contact portion 132. The opposite end of the protrusion 131 has a base 133. The base 133 is inserted into the liquid metals 12. An elastic body 20 (such as: a spring or another kind of elastomer) is installed between the two conductors. Two ends of the elastic body 20 are connected respectively to the two protrusions 131 so as to offer enough elasticity for the two conductors and provide higher positive pressure when the conductors are compressed to be in contact with the circuit boards.

The liquid metals 12 are received in the space formed by the receiving space 16 and the protrusion 131 of the two conductors 13 so as to complete the conduction of the two conductors 13. The contact portion 132 protrudes out of the small opening 17 so as to connect with the electric elements and complete the electric conductions of the two connecting electric elements.

Figure 2:
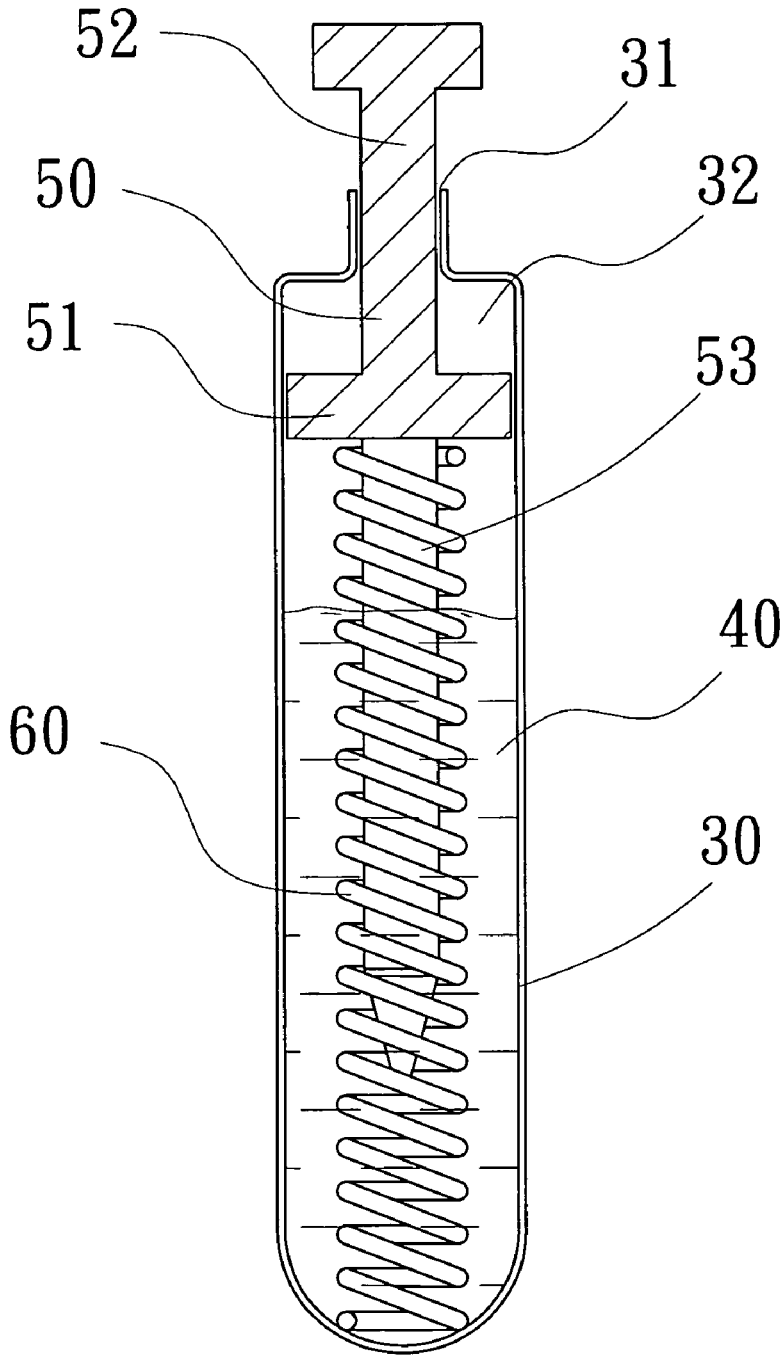
FIG. 2 is a perspective view of the electric element of another embodiment of the present invention.

FIG. 2 is illustrated with another embodiment of the present invention. The electric element of the present invention is a probe. The probe comprises a metal chamber 30. One end of the metal chamber 30 has a small opening 31. The metal chamber 30 has a receiving space 32. The receiving space 32 is received with liquid metals 12 with low impedance (such as: mercury). A conductor 50 is installed in the small opening 31. The conductor 50 comprises a protrusion 51 with larger size than the small opening 31 and a contact portion 52 extended from the protrusion 51. The protrusion 51 is installed in the receiving space 32 and is close to the corresponding small opening 31. The contact portion 52 protrudes out of the small opening 31.

A base 53 is installed in the protrusion 51 on the opposite side of the contact portion 52 of the conductor. The base 53 is inserted into the liquid metals 40. The opposite side of the conductor is connected to the metal chamber 30 with an elastic body 60 (such as: a spring or another kind of elastomer). The two ends of the elastic body 60 are connected respectively to the protrusion 51 and the bottom of the metal chamber 30 so as to provide the other conductor enough elasticity.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric element having liquid metals for connection of two corresponding electric elements comprising:

two conductors; and liquid metals with low impedance connecting to the two conductors, wherein the two conductors keep in contact with the liquid metals at a situation of relative movement, wherein one conductor is a metal chamber with one end opening; the one conductor has a receiving space; the liquid metals are received in the receiving space; and the other conductor is installed in the one end opening, the one end opening of the receiving space has a small opening;

wherein the other conductor comprises a protrusion with larger size than the small opening; a contact portion extending from the protrusion; the protrusion is installed in the receiving space and is close to the small opening; and the contact portion protruding outwardly from the small opening, wherein a base is installed on the protrusion on the opposite of the contact portion; and the base is inserted into the liquid metals.

2. The electric element as claimed in claim 1, further comprising an elastic body directly engaging and pressing the protrusion toward the small opening.

3. The electric element as claimed in claim 1, wherein the electric element is a probe.

4. An electric element having liquid metals for connection of two corresponding electric elements comprising:

two conductors; and liquid metals with low impedance connecting to the two conductors, wherein the two conductors keep in contact with the liquid metals at a situation of relative movement, wherein the electric element has insulating bodies; the insulating bodies have a receiving space for receiving liquid metals; each of the two ends of the receiving space has a small opening; and two conductors are installed respectively in the small openings of one of the two ends, wherein each conductor comprises a protrusion with larger size than the small opening; a contact portion extending from the protrusion; the protrusion is installed in the receiving space and is close to the corresponding small opening; and each contact portion protruding outwardly from one small opening, wherein a base is installed on the protrusion on the opposite of the contact portion; and the base is inserted into the liquid metals.

5. The electric element having liquid metals as claimed in claim 4, wherein an elastic body is installed between the two conductors.

6. The electric element having liquid metals as claimed in claim 4, wherein the electric element is a conductor for connecting one board to another board.

7. An electric element having liquid metals for connection of two corresponding electric elements comprising:

a) an insulating body having a receiving space and at least one opening;

b) liquid metals having low impedance and filling a center portion of the receiving space and being spaced apart form the at least one opening; and c) at least one conductor having:

i) a protrusion located in the receiving space and having a size larger than a size of the at least one opening;

ii) a contact portion protruding outwardly from a first side of the protrusion and extending outwardly from the insulating body through the at least one opening; and iii) a base protruding outwardly from a second side of the protrusion and being inserted into the liquid metals.

8. The electric element having liquid metals as claimed in claim 7, wherein the base contacting the liquid metals irregardless of the orientation of the insulating body.

9. The electric element having liquid metals as claimed in claim 7, further comprising an elastic body directly engaging and pressing the protrusion toward the opening.

10. The electric element having liquid metals as claimed in claim 7, wherein the electric element is a conductor for connecting one board to another board.

11. The electric element having liquid metals as claimed in claim 7, wherein the electric element is a probe.

12. The electric element having liquid metals as claimed in claim 7, wherein the at least one opening of the insulating body includes two openings located on opposite sides of the receiving space, the at least one conductor includes two conductors, each of the two conductors is located in one of the two openings.

13. The electric element having liquid metals as claimed in claim 12, further comprising an elastic body directly engaging and pressing the protrusion of each of the two conductors toward one of the two openings.

* * * * *